US007836871B2

(12) United States Patent
Kempf

(10) Patent No.: US 7,836,871 B2
(45) **Date of Patent: *Nov. 23, 2010**

(54) POWERSTROKE CROSSBOW

(76) Inventor: James J. Kempf, 3201 12th Ave., Coralville, IA (US) 52241

( * ) Notice: Subject to any disclaimer, the term of this patent is extended or adjusted under 35 U.S.C. 154(b) by 672 days.

This patent is subject to a terminal disclaimer.

(21) Appl. No.: 11/654,418

(22) Filed: Jan. 17, 2007

(65) Prior Publication Data

US 2008/0168969 A1 Jul. 17, 2008

(51) Int. Cl.
*F41B 5/12* (2006.01)

(52) U.S. Cl. ..... 124/25; 124/25.6

(58) Field of Classification Search ..... 124/23.1, 124/24.1, 25, 25.6
See application file for complete search history.

(56) References Cited

U.S. PATENT DOCUMENTS

| | | | | |
|---|---|---|---|---|
| 2,100,317 | A | 11/1937 | Hickman | |
| 2,957,470 | A | 10/1960 | Bama | |
| 3,238,935 | A | 3/1966 | Stanaland | |
| 3,515,113 | A | 6/1970 | Lawrence | |
| 4,722,317 | A | 2/1988 | Hartwig | |
| 4,766,874 | A | 8/1988 | Nishioka | |
| 4,879,987 | A | 11/1989 | Nishioka | |
| 4,926,834 | A | 5/1990 | Chauvin | |
| 4,976,250 | A | 12/1990 | Jeffrey | |
| 5,368,006 | A | 11/1994 | McPherson | |
| 5,630,405 | A | 5/1997 | Nizov | |
| 6,155,243 | A | 12/2000 | Gallops, Jr. | |
| 6,267,108 | B1 | 7/2001 | McPherson et al. | |
| 6,460,528 | B1 | 10/2002 | Gallops, Jr. | |
| 7,363,921 | B2 * | 4/2008 | Kempf | 124/25 |
| 2006/0081232 | A1 * | 4/2006 | Woodland | 124/25.6 |

* cited by examiner

*Primary Examiner*—John Ricci
(74) *Attorney, Agent, or Firm*—Brett Trout

(57) ABSTRACT

A crossbow having an increased powerstroke and reduced noise. The powerstroke is increased by inverting the limb orientation from the standard crossbow arrangement and locating string guides at least partially forward and rearward of the ends of the limbs. The bowstring is drawn from the tops of the string guides to maximize the powerstroke, reducing noise and increasing the retained and delivered energy over existing crossbows.

20 Claims, 10 Drawing Sheets

POWERSTROKE CROSSBOW

BACKGROUND OF THE INVENTION

1. Field of the Invention

The present invention relates in general to an improved crossbow and, more particularly, to a crossbow having improved speed and reduced noise characteristics.

2. Description of the Prior Art

Crossbows have been known for centuries. By allowing the shooter to mechanically retain the bow in the cocked position, the shooter is provided an advantage over a traditional archer who must utilize muscular force to retain the bow in the cocked position. While crossbow design remained substantially unchanged until the twentieth century, crossbow design has been subject to many recent developments which have dramatically increased performance.

One improvement has been the provision of cams on the crossbow to increase the mechanical advantage associated with the draw of the bowstring. One drawback associated with such cams is the requirement that the cams be "synchronized" to prevent lateral travel of the rear of the projectile during launch. While such problems are less dramatic in crossbows than in traditional bows, developments such as the utilization of a single cam arrangement, such as that described in McPherson, U.S. Pat. No. 6,267,108, substantially reduces the problems associated with "synchronization."

Such crossbows still have several drawbacks. As with crossbows of the past, these newer crossbows still locate the limbs of the bows near the forward most portion of the crossbow rail. This orientation positions the bowstring substantially further back along the rail, drastically decreasing the draw length of the crossbow, simultaneously sacrificing speed, and necessarily increasing the draw weight required to obtain desired performance.

As described in Nishioka, U.S. Pat. No. 4,879,987, it is known to reverse the positioning of the limbs in a crossbow to place the bowstring closer to the end of the rail, thereby increasing draw length and the associated power of the crossbow. However, although such devices provide for an increased draw length, by drawing the bowstring from the rear of the cams located on the limbs, the draw length is still not effectively maximized. Additionally, utilizing brackets to locate the cams inward and short of the ends of the limbs, further decreases the potential power of such devices. Still another drawback with such devices is the inclusion of additional cams located on the frame, which increases cost, weight and maintenance of such devices, as well as adding additional friction to further diminish the potential power of the crossbow.

As shown in Nizov, U.S. Pat. No. 5,630,405, it is known in the art to position the cams closer to the ends of the limbs to further increase the power of the crossbow. Such devices also have drawbacks, however, including the pulling of the bowstring from the rear of the cams, which reduces the draw length of the crossbow. Additionally, Nizov fails to position the bowstring at the end of the rail, thereby sacrificing overall draw length and power. Nizov also requires that the majority of the projectile be positioned behind the cocked position of the bowstring. Such an orientation increases the required length of the rail, while failing to provide any concomitant increase in draw length. It would be desirable to increase the utilization of the rail to increase power and reduce the weight and bulkiness of the crossbow.

As described in Nishioka, U.S. Pat. No. 4,766,874, it is known in the art to provide a crossbow with the above described reverse limb orientation to increase draw length, and to further draw the bowstring from the forward portion of the cams to additionally increase draw length, and the associated power stroke. One drawback associated with such devices, however, is the decrease in draw length associated with providing brackets which locate the limb cams rearwardly and inwardly of the limbs. An additional drawback is that such devices locate the bowstring substantially rearward of the end of the crossbow rail, substantially reducing the draw length and power stroke. It would be possible to increase the powerstroke associated with prior art crossbows by increasing the axle-to-axle distance associated with the axles journaling the limb cams to the limbs. Larger axle-to-axle distances, however, are undesirable, especially in hunting and/or tree stand applications where the increased size and weight associated with the increased axle-to-axle distance would make hunting more difficult. It would, therefore, be desirable to minimize the ratio of the axle-to-axle distance to the powerstroke.

Still another drawback associated with such devices is the inclusion of pulleys located below the rail of the crossbow. This additional feature increases the weight, cost and maintenance of such devices, while adding additional friction, further decreasing the potential speed of the crossbow. It would be advantageous to eliminate these additional frictional elements and to increase the power stroke to exploit the full length of the rail in imparting power to the projectile.

As noted above, while there have been several advancements in the field of crossbows, the existing prior art evidences numerous drawbacks, including the failure to utilize the entire potential power stroke of both the forward and rearward ends of the rail, undesirable location of pulleys and cams, and the inclusion of additional frictional parts, further robbing the crossbow projectile of additional speed. The difficulties encountered in the prior art discussed hereinabove are substantially eliminated by the present invention.

SUMMARY OF THE INVENTION

In an advantage provided by this invention, a crossbow is provided which is of a low-cost, simple manufacture.

Advantageously, this invention provides a crossbow of a compact, lightweight construction.

Advantageously, this invention provides a crossbow of a reduced ratio of the axle-to-axle distance to the powerstroke.

Advantageously, this invention provides a crossbow with reduced maintenance requirements.

Advantageously, this invention provides a crossbow with an increased power stroke.

Advantageously, this invention provides a crossbow which reduces the force required to draw the bowstring.

Advantageously, this invention provides a crossbow which reduces noise associated with launch of a projectile.

Advantageously, this invention provides a crossbow with an increased draw length, allowing the utilization of standard arrows.

Advantageously, in the preferred embodiment of this invention, a shooting bow is provided with a frame coupled to two limbs extending outwardly away from one another in the direction of shooting. A first string guide member is journaled to the first limb, and a second string guide member is journaled to the second limb. The first string is coupled to the first string guide and the second string guide. A second string is coupled from a first point on the first string guide, forward of the point where the first string guide is journaled to the first limb and to a second point on the second string guide, forward of the point where the second string guide is journaled to the second limb. Means are provided for retaining the second string in a cocked position, and trigger means are provided for causing the retaining means to release the second string. Preferably, the first string guide is a cam and the second string guide is a pulley, each positioned at the ends of their respective limbs.

BRIEF DESCRIPTION OF THE DRAWINGS

The present invention will now be described, by way of example, with reference to the accompanying drawings in which:

FIG. 9 illustrates a side elevation in cross-section of the locking mechanism of FIG. 5, shown with the trigger actuated and the bowstring released from the string retainer.

DETAILED DESCRIPTION OF THE PREFERRED EMBODIMENT

Figure 1:
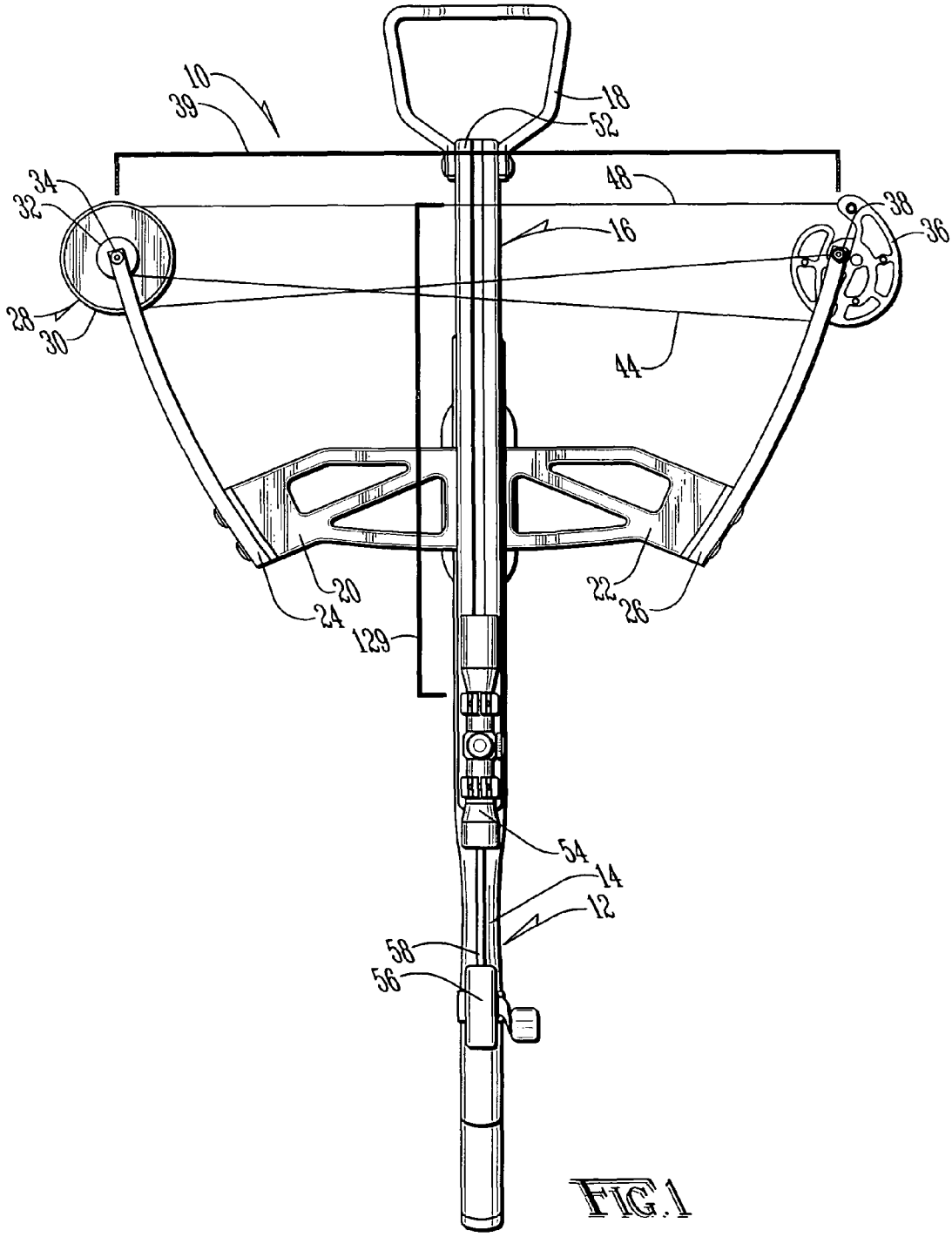
FIG. 1 illustrates a top plan view of the crossbow of the present invention.
Figure 2:
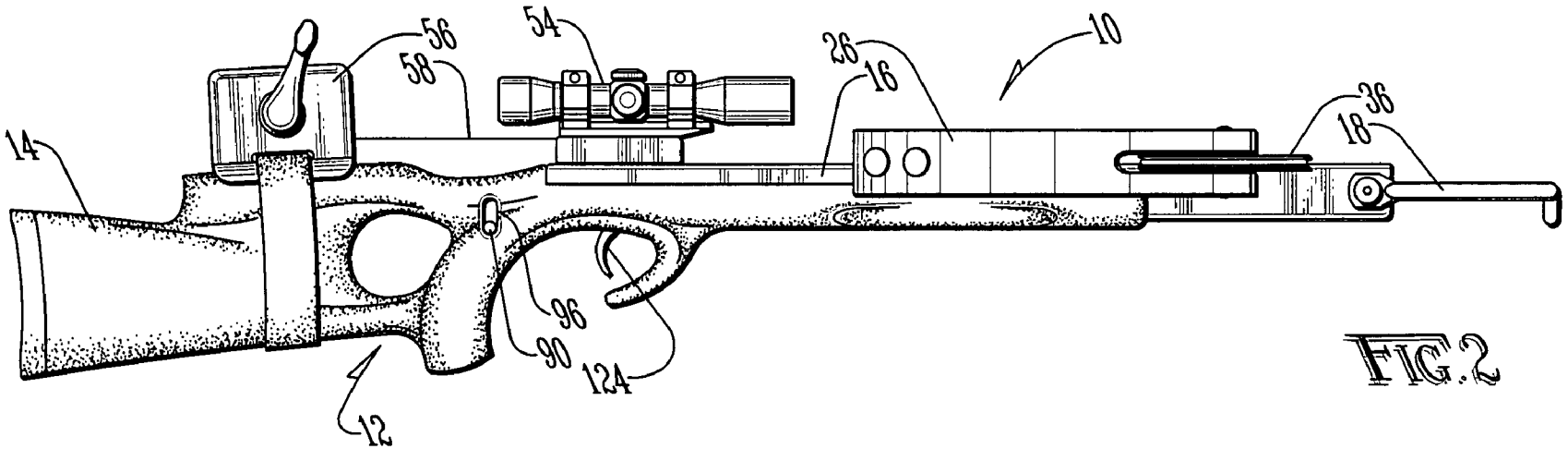
FIG. 2 illustrates a side elevation of the crossbow of FIG. 1.

A crossbow according to the present invention is shown generally as (10) in FIG. 1. As shown in FIGS. 1 and 2, the crossbow (10) is provided with a frame (12) which includes a stock (14) and a rail (16). Although the stock (14) and rail (16) maybe of any type known in the art, in the preferred embodiment the stock (14) is of a composite material construction, and the rail (16) is constructed of aluminum. Alternatively, the crossbow (10) may be of a "railless" design, such as those known in the art.

Figure 3:
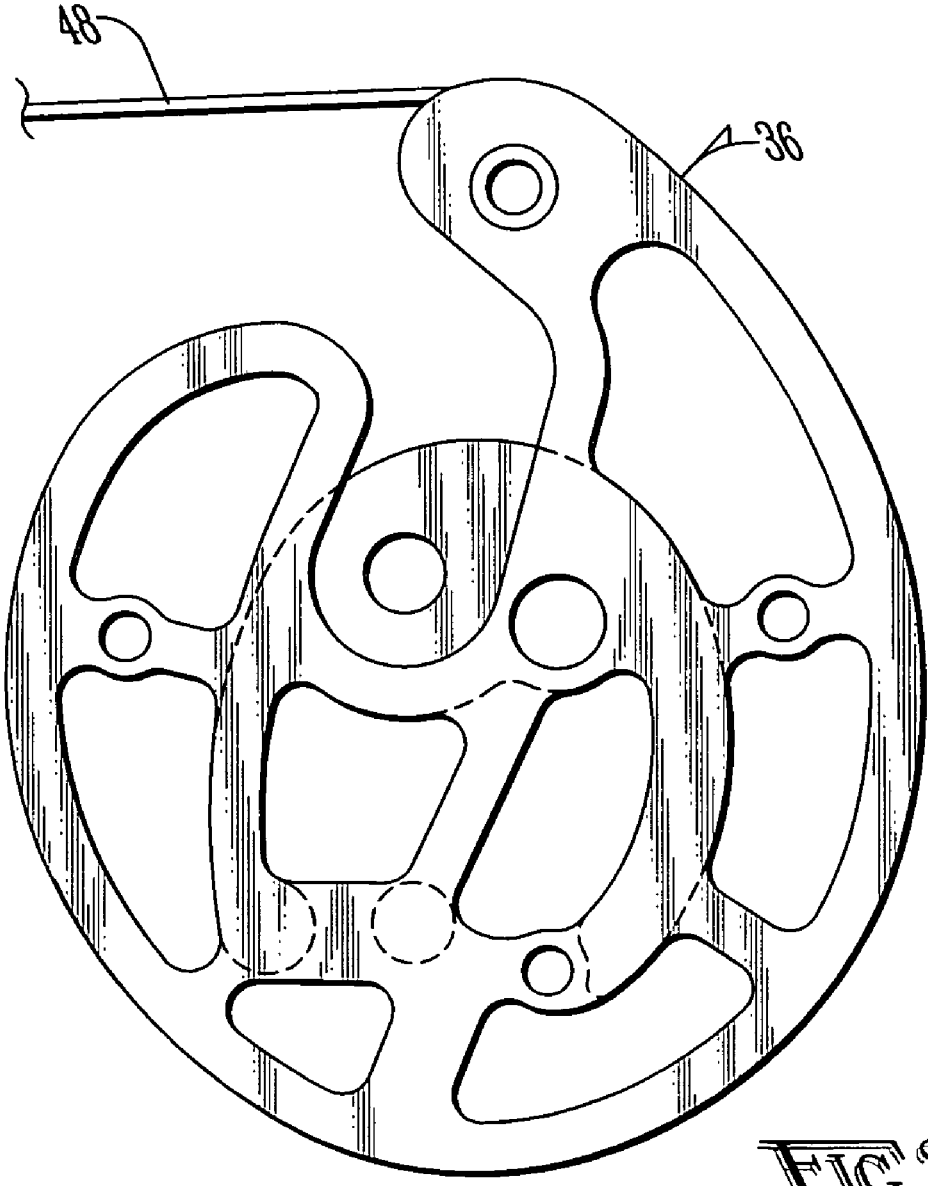
FIG. 3 illustrates a bottom plan view of the cam associated with the crossbow of FIG. 1.

The crossbow (10) is provided with a pivotable foot stirrup (18) to facilitate cocking of the crossbow (10). As shown in FIG. 1, the crossbow (10) is also provided with a pair of risers (20) and (22) secured to the rail (16). The risers (20) and (22) are preferably constructed of aluminum to reduce weight. Coupled to the risers (20) and (22) are limbs (24) and (26). The limbs (24) and (26) are constructed and coupled to the risers (20) and (22) in a manner such as that known in the art. Coupled to the first limb (24) is a first string guide, which in the preferred embodiment is a pulley (28), having an outer track (30) and an inner track (32). The pulley (28) is preferably journaled to the end of the limb (24) by an axle (34). The pulley (28) is preferably journaled to the limb (24) in a manner which positions a portion of the pulley (28) forward and outward of the space defined between the limbs (24) and (26). As shown in FIG. 1, a second string guide, which in the preferred embodiment is a cam (36), is journaled to the second limb (26) by an axle (38). The cam (36) is also journaled to the second limb (26) so that at least a portion of the cam (36) extends forward and outward of the area defined between the limbs (24) and (26). The cam (36) is preferably less than twenty centimeters, more preferably less than fifteen centimeters and most preferably ten and eight tenths (10.8) centimeters in diameter. The cam (36) is preferably constructed as shown in FIG. 3, but may be constructed in a manner known in the art.

Preferably, the distance (39) between the axles (34) and (38) in the fixed position shown in FIG. 1 is less than ninety-five centimeters, more preferably less than eighty-five centimeters, and most preferably, less than seventy-five centimeters. If desired, two synchronized cams (not shown) may be used in place of the cam (36) and pulley (28). The cam (36) and pulley (28) may be coupled to a bowstring (48) and, if desired, one or more cables in any manner known in the art, but the bowstring (48) is preferably located, as shown in FIG. 1, forward of the points on the limbs (24) and (26) where the cam (36) and pulley (28) are journaled to the limbs (24) and (26).

Figure 4:
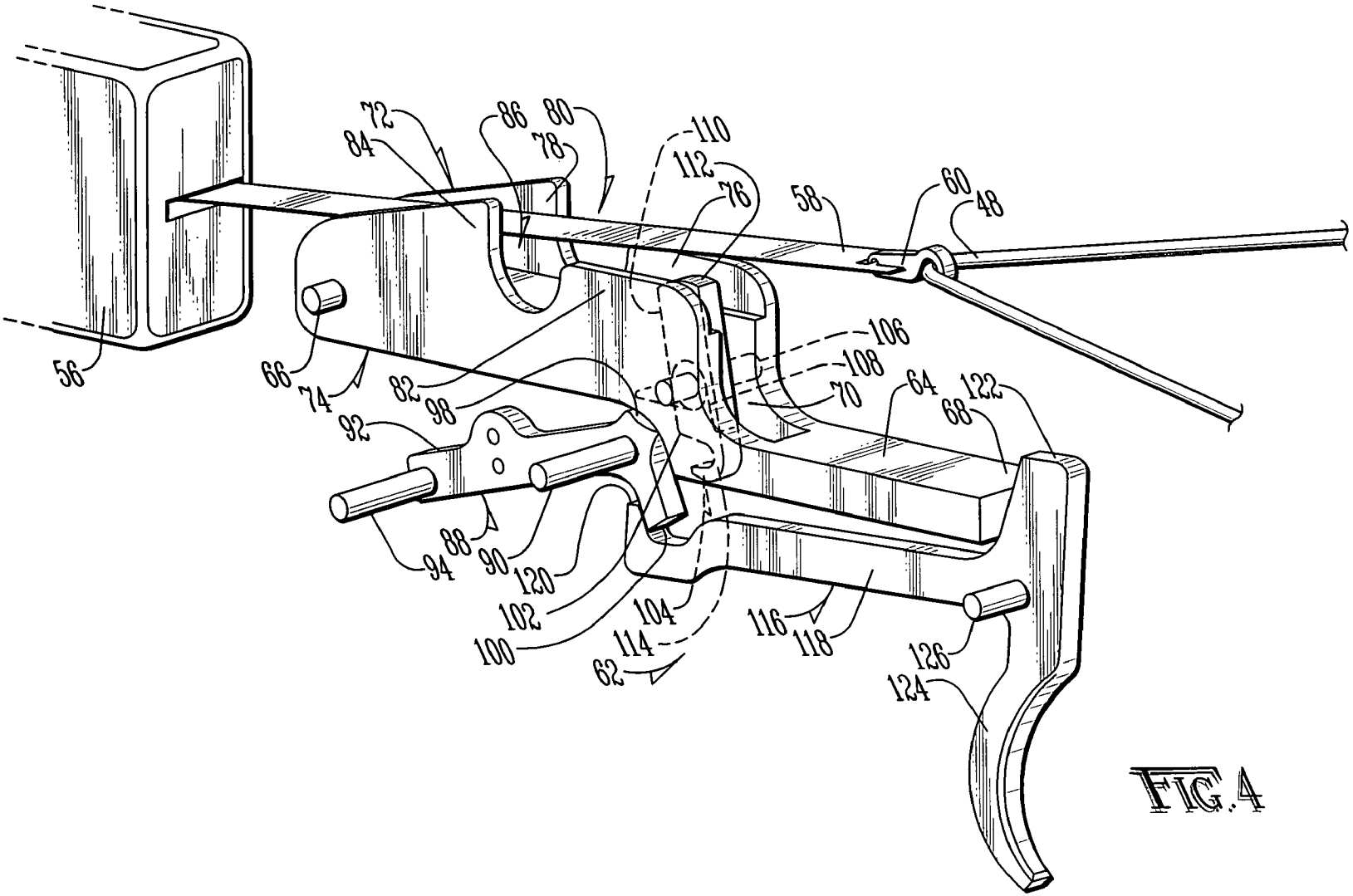
FIG. 4 illustrates a side perspective view of the locking mechanism of the present invention.

As shown in FIG. 1, the foregoing orientation of the pulley (28), cam (36), cable (44) and bowstring (48) positions the bowstring (48) very close to the forward end (52) of the rail (16). As shown in FIG. 2, secured above the rail (16) is a scope (54). Releasably secured to the stock (14) is a cocker mechanism (56), such as those known in the art. Alternatively, a cocker mechanism may be integrated into the frame (12). Extending from the cocker mechanism (56) is a band (58) used to draw the bowstring (48). As shown in FIG. 4, however, unlike prior art cocking strings, the band (58) is provided with a single attachment point hook (60) to engage the bowstring (48). The cocker mechanism (56) may be of an ordinary dog and pawl construction, or any similarly suitable construction designed to retract the band (58).

As shown in FIG. 4, the cocker mechanism (56) draws the band (58) over a locking assembly (62). The locking assembly (62) includes a retainer bar (64), a safety assembly (88), a dryfire bar (104) and a trigger assembly (116). The retainer bar (64) is pivotally mounted to the frame (12) by an axle (66). FIGS. 2 and 4. The retainer bar (64) is preferably constructed of hardened steel and is journaled to the frame (12) preferably at a point at least ten centimeters, more preferably at least twelve centimeters, and most preferably at least fourteen centimeters from the sear (68) which forms the end of the retainer bar (64).

As shown in FIG. 4, the retainer bar (64) is provided with a slot (70) defined by a left wall (72) and a right wall (74). The left wall (72) includes a left string retainer (76) and a left string engager (78). The string retainer (76) and string engager (78) define a left string slot (80) therebetween. Similarly, the right wall (74) includes a right string retainer (82) and a right string engager (84) coacting to define a right string slot (86).

As shown in FIG. 4, the safety assembly (88) is pivotally coupled to the frame (12) by an axle (90). The safety assembly (88) includes a hardened steel safety bar (92) coupled to an actuation pin (94) which extends through a slot (96) provided in the stock (14). FIGS. 2 and 4.

Figure 5:
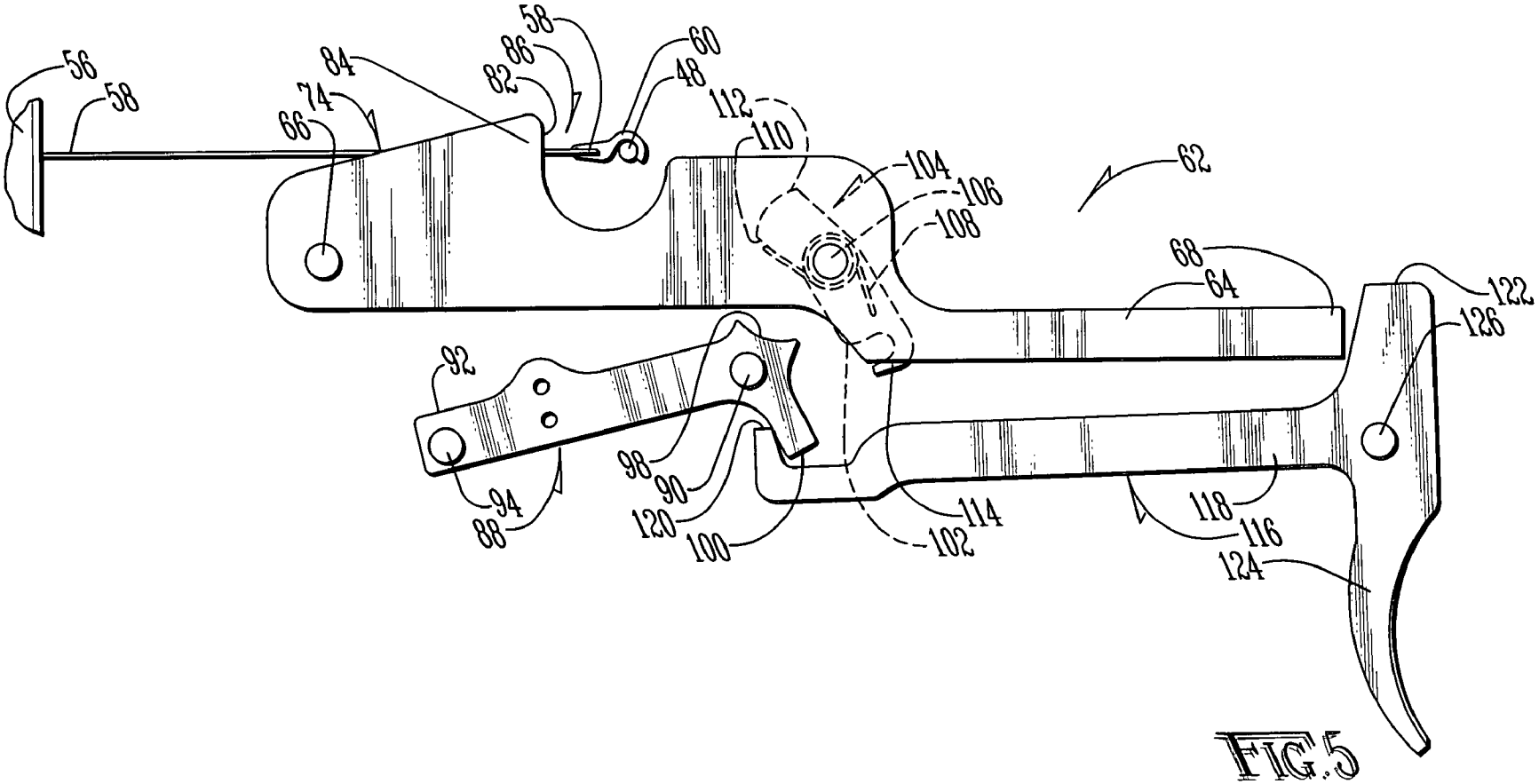
FIG. 5 illustrates a side elevation in cross-section of the locking mechanism of the present invention, shown with the bowstring drawn between the string retainers.

As shown in FIG. 5, the safety bar (92) defines a dryfire catch (98) and a trigger bar sear (100). The dryfire catch (98) is preferably provided with an arcuate surface as shown in FIG. 5 to accommodate the curved end (102) of the dryfire bar (104). As shown in FIGS. 4 and 5, the dryfire bar (104) is pivotally coupled to the retainer bar (64) by an axle (106). The dryfire bar (104) preferably rests within the slot (70) defined by a left wall (72) and right wall (74) of the locking assembly (62). (FIGS. 4-5). As shown in FIG. 5, a torsion spring (108) may be secured to the left wall (72) and right wall (74). As shown, the torsion spring (108) wraps around the axle (106) on either side of the dryfire bar (104) and wraps around the back (110) of the dryfire bar (104) to motivate the dryfire bar (104) toward an upright position. Any type of spring, or even gravity, may be utilized to motivate the dryfire bar (104) toward an upright position. As shown in FIG. 5, the dryfire bar (104) is provided on one end with a projectile engager (112) and on the opposite end with a hook (114).

As shown in FIG. 5, the trigger assembly includes a trigger bar (118), a safety engager (120), a sear engager (122) and a trigger (124), all integrally formed from a single piece of hardened steel. The trigger assembly (116) is journaled to the frame (12) by an axle (126). FIGS. 2 and 5. The extended length of the retainer bar (64) and trigger bar (118) are preferred as this construction reduces wear on the sears (68) and (100), extends the life of the parts, and provides a lighter trigger pull, while still maintaining safety of the mechanism. Additionally, by locating the string retainers (76) and (82) rearward of the trigger (124), an increased power stroke is available, allowing the crossbow (10) to store and deliver more energy to a projectile.

As shown in FIG. 5, the trigger assembly (116) is journaled to the frame (12) in a manner which motivates the trigger assembly (116) in a counterclockwise rotation, given the weight distribution of the elements of the trigger assembly (116) relative to the axle (126). Preferably, the trigger assembly (116) is provided with a set screw (not shown) to allow for trigger pull adjustment in a manner such as that known in the art.

Figure 6:
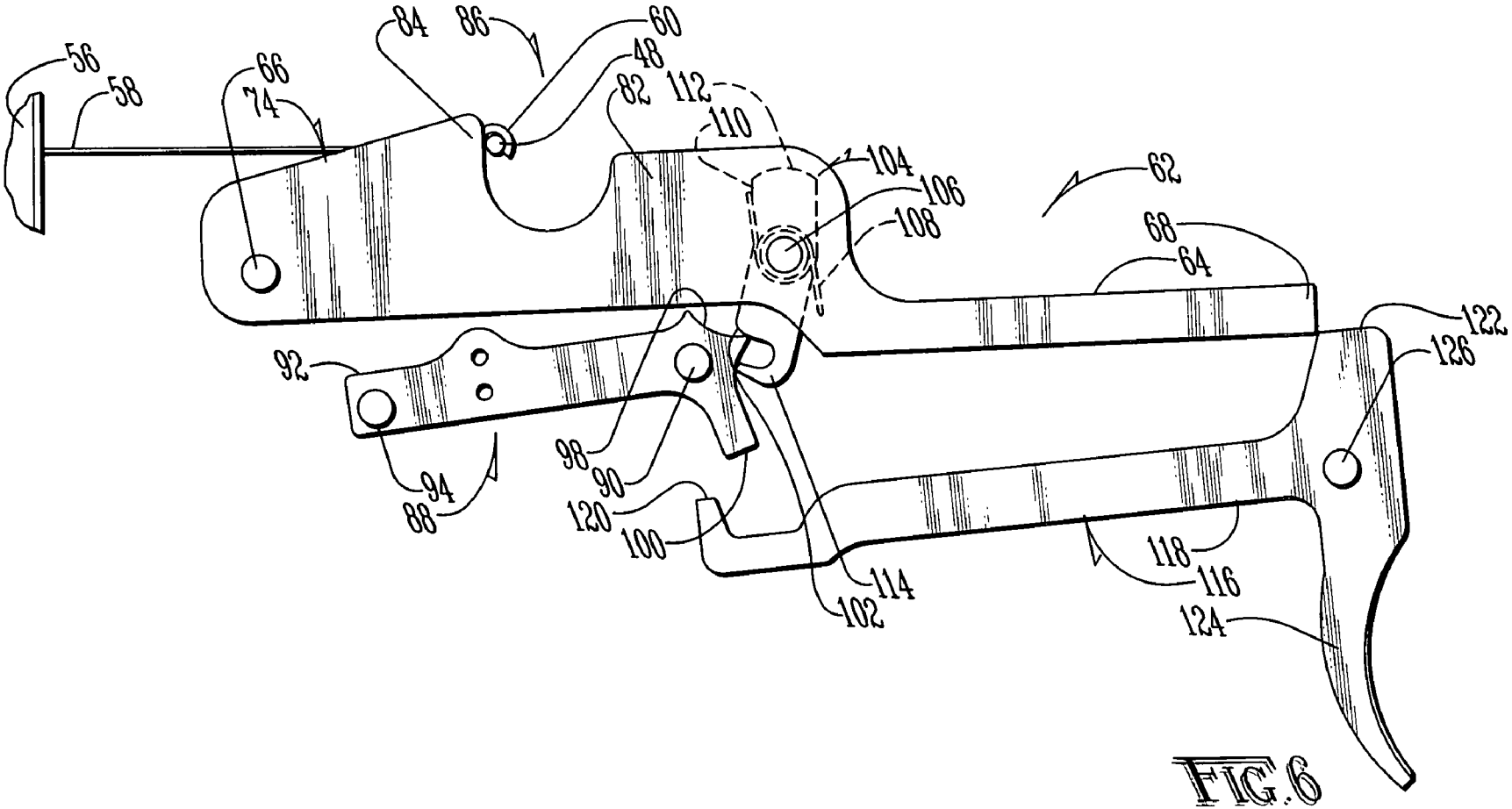
FIG. 6 illustrates a side elevation in cross-section of the lock assembly of FIG. 5, shown with the string engaging the rear of the retainer bar.

When it is desired to load and fire the crossbow (10), the cocker mechanism (56) is released to allow the band (58) and hook (60) to be extended and engaged with the bowstring (48). The cocker mechanism (56) is thereafter actuated utilizing the handle (130), a power drill (not shown), or any other suitable means known in the art to begin retracting the band (58) and hook (60) toward the cocker mechanism (56). As shown in FIG. 4, as the cocker mechanism (56) draws the bowstring (48) rearward, the band (58) passes between the downwardly rotated string retainers (76) and (82). As shown in FIG. 5, as the cocker mechanism (56) retracts the bowstring (48), the trigger assembly (116) is in the fired position, having previously released the sear (68) from the sear engager (122). This causes the retainer bar (64) to pivot downward, creating the required clearance between the hook (60) and the tops of the string retainers (76) and (82). As shown, the safety assembly (88) is disengaged, allowing the trigger bar (118) to pivot past the trigger bar sear (100) and to allow the curved end (102) of the dryfire bar (104) to move past the dryfire catch (98). As shown in FIG. 6, as the cocker mechanism (56) continues to draw the bowstring (48) rearward, the bowstring (48) contacts the string engagers (78) and (84). (FIGS. 4 and 6). As the cocker mechanism (56) continues to exert force against the string engagers (78) and (84) via the bowstring (48), the retainer bar (64) begins to rotate counterclockwise, raising the sear (68) above the sear engager (122). The weight of the trigger assembly (116) rotates the sear engager (122) under the sear (68). Additionally, the hook (114) associated with the dryfire bar (104) engages the safety bar (92).

Figure 7:
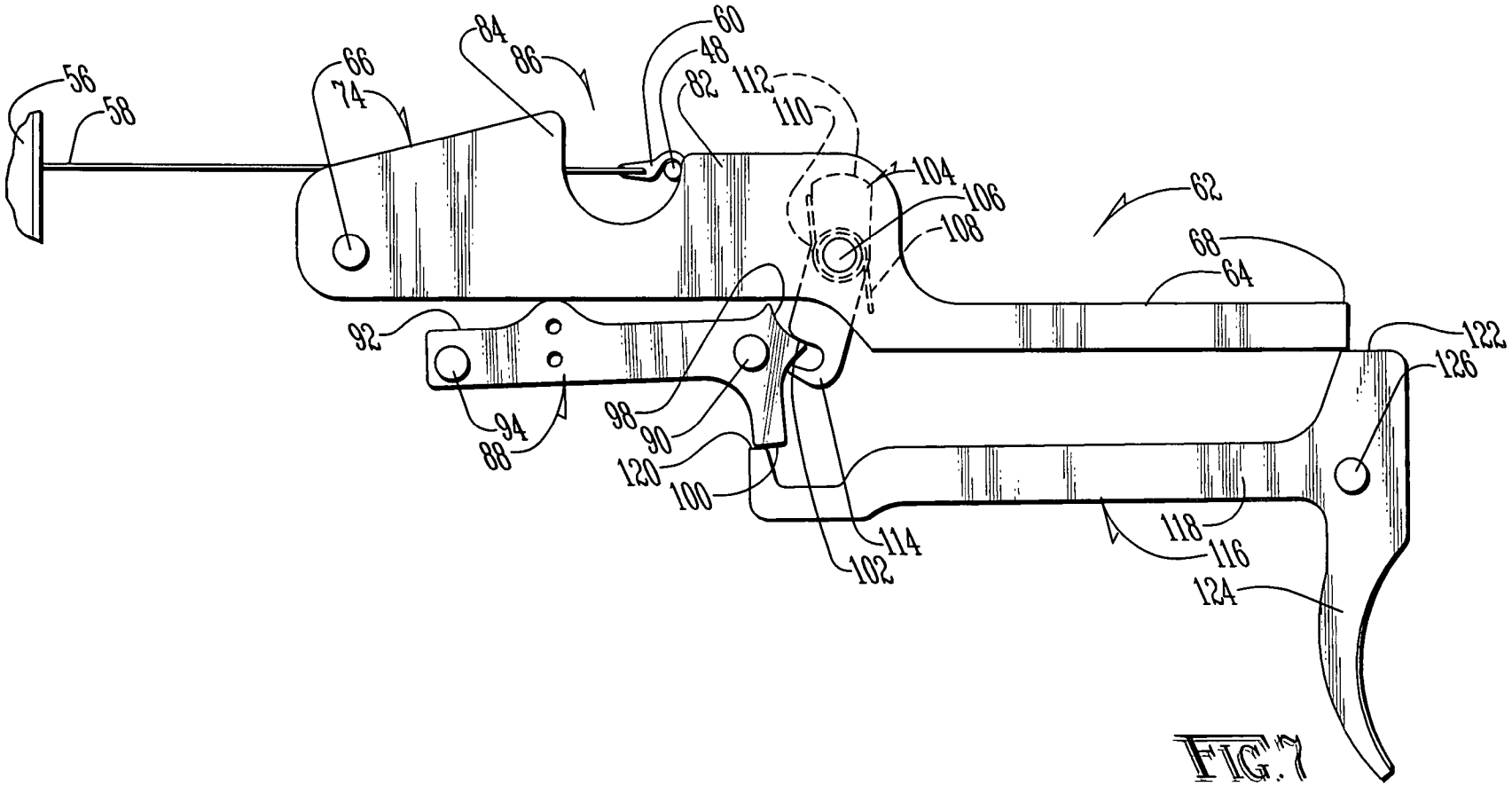
FIG. 7 illustrates a side elevation in cross-section of the locking mechanism of FIG. 5, shown with the locking mechanism in the cocked position.

Thereafter, as the cocker mechanism (56) is actuated to release the bowstring (48), the band (58), hook (60) and bowstring (48) move forward as shown in FIG. 7. As pressure is released from the string engagers (78) and (84), the retainer bar (64) rotates clockwise under the force of gravity to move the sear (68) into engagement with the sear engager (122) and to cause the trigger bar sear (100) to move into engagement with the safety engager (100). Additionally, the curved end (102) of the dryfire bar (104) moves into engagement with the dryfire catch (98). In this orientation, the safety assembly (188) prevents actuation of the trigger assembly (116) as the bowstring (48) continues to move forward into contact with the string retainers (76) and (82). Because there are two retainers (76) and (82), located on either side of the hook (60), a single hook may be utilized instead of prior art utilization of a dual hook assembly. This orientation not only reduces parts and increases the repeatability of the draw, it also reduces stress on the nock point of the bowstring (48).

Figure 8:
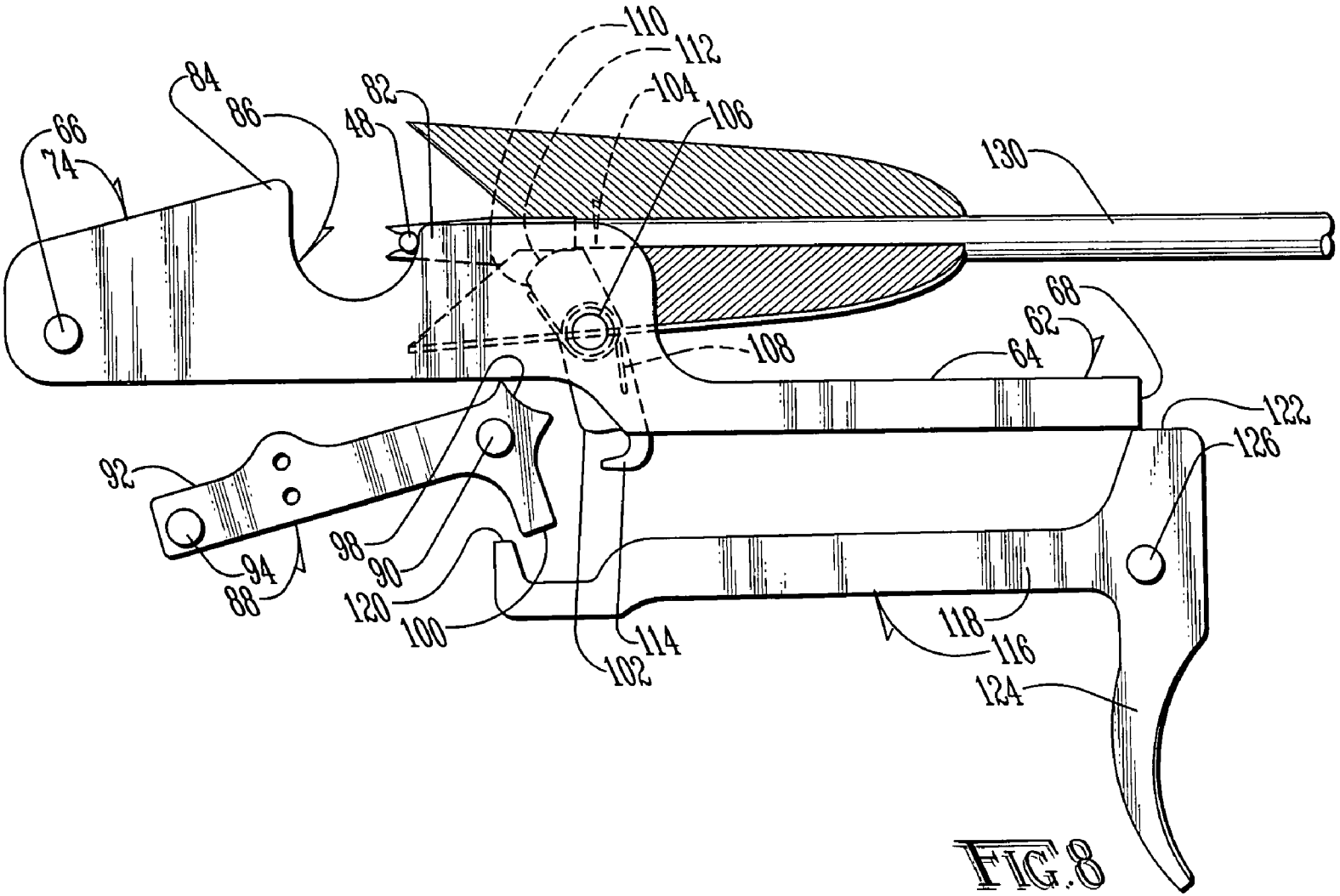
FIG. 8 illustrates a side elevation in cross-section of the locking mechanism of FIG. 5, shown with a projectile positioned between the string retainers and the safety released.
Figure 8:
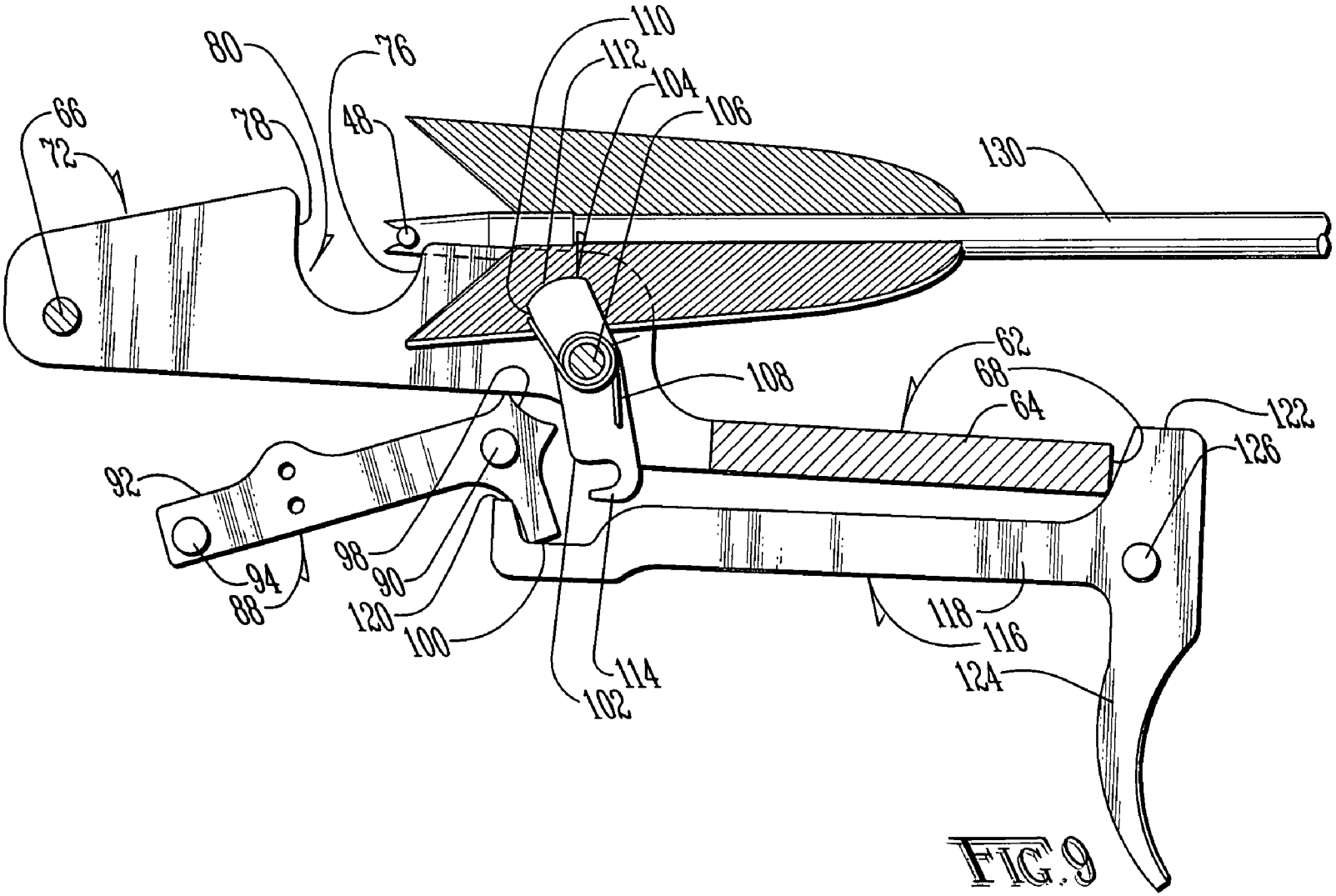
Figure 10:
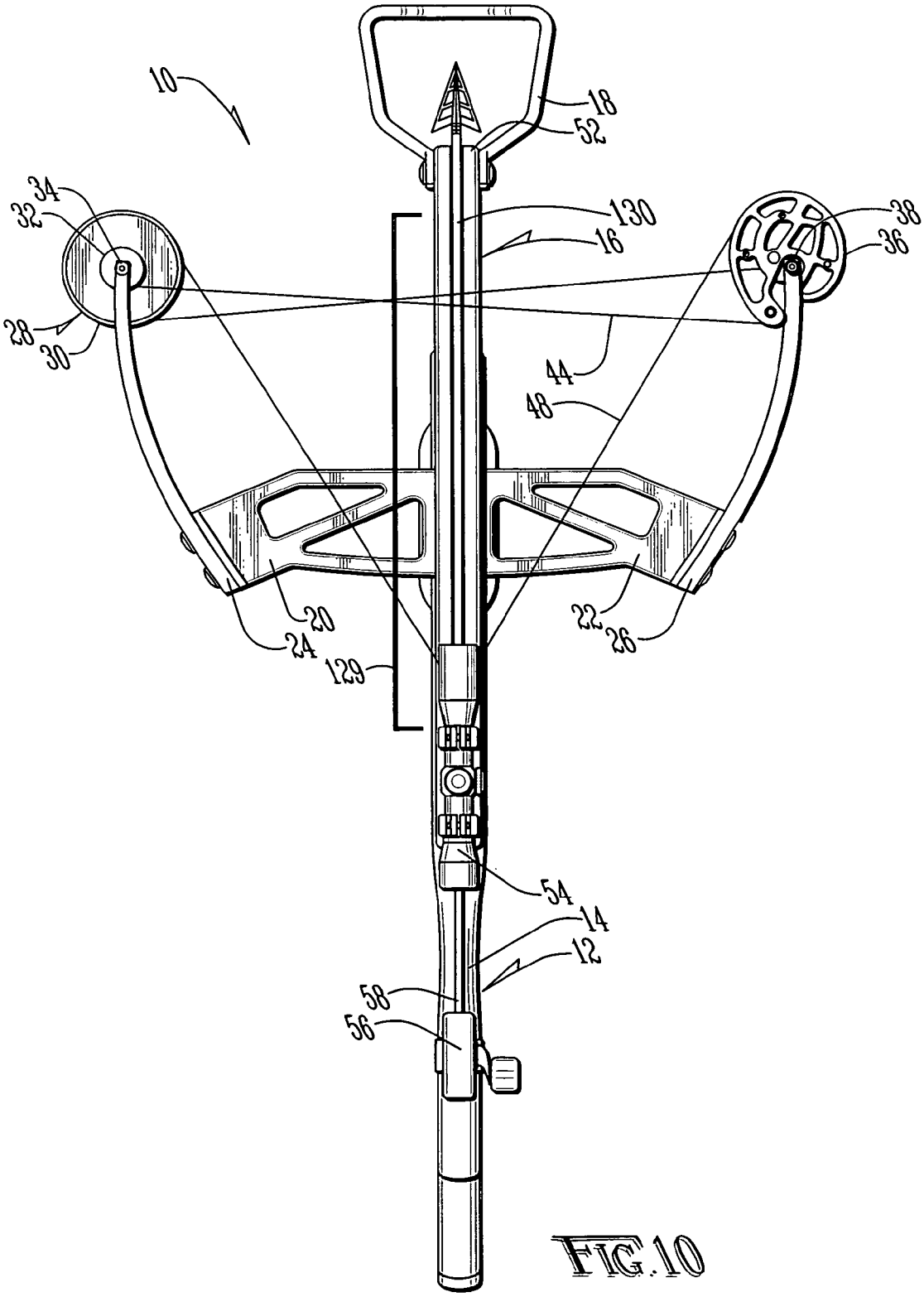
FIG. 10 illustrates a top plan view of the crossbow of the present invention in the cocked position.

After the crossbow (10) has been cocked as described above, a projectile such as an arrow (130) is positioned along the rail (16) as shown in FIG. 8. (FIGS. 1 and 8.) Given the increased power stroke of the present invention, standard arrows may be used in place of standard crossbow bolts. As shown, placement of the arrow (130) between the left wall (72) and right wall (74) of the locking assembly (62) forces the projectile engager (112) portion of the dryfire bar (104) downward and rearward, causing the dryfire bar (104) to rotate out of engagement with the safety assembly (88). (FIGS. 4 and 8). Thereafter, the actuation pin (94) of the safety assembly (88) may be actuated to rotate the safety assembly (88) from the safe position to the fire position as shown in FIG. 8. As shown in FIG. 10, the powerstroke (129), or distance the portion of the bowstring in contact with the arrow (130) moves from a cocked to a fired position, is preferably at least thirty-five (35) centimeters, more preferably at least forty (40) centimeters, and most preferably forty-five (45) centimeters. Also, the axle-to-axle distance (39) of the crossbow (10) is preferably less than one hundred twenty centimeters, more preferably less than one hundred centimeters, and most preferably less than ninety centimeters. Also, the ratio of the powerstroke (129) to the axle distance (39) is preferably between 0.6 and 1.1.

When it is desired to fire the crossbow (10), the trigger (124) is moved rearward, causing the sear engager (122) of the trigger assembly (116) to rotate out of engagement with the sear (68), and allowing the retainer bar (64) to rotate clockwise, thereby allowing the bowstring (48) to release from the string engagers (78) and (84) and propel the arrow (130) forward.

Although the invention has been described with respect to a preferred embodiment thereof, it also to be understood it is not to be so limited, since changes and modifications can be made therein which are within the full, intended scope of this invention as defined by the appended claims. As an example, the locking mechanism described above may be constructed of any suitable parts and any suitable dimensions.

What is claimed is:

1. A shooting bow comprising:

(a) a frame;

(b) a first limb;

(c) a second limb;

(d) wherein said first limb and said second limb are coupled to said frame in a manner in which said first limb and said second limb extend outwardly away from one another in a direction of shooting;

(e) a first string guide journaled to said first limb at a first point;

(f) a second string guide journaled to said limb at a second point;

(g) wherein said first point is located no more than ninety-five centimeters from said second point;

(h) a first string coupled to said first string guide and to said second string guide;

(i) a second string coupled from a first contact on said first string guide forward of said first point to a second contact on said second string guide forward of said second point;

(j) a locking assembly configured to receive said second string;

(k) a trigger coupled to said locking assembly; and (l) a rail coupled to said frame and configured to receive a majority of a projectile forward of said locking assembly when said locking assembly is in receipt of said second string.

2. The shooting bow of claim 1, wherein said first point is located no more than eighty-five centimeters from said second point.

3. The shooting bow of claim 2, wherein said locking assembly is configured to receive said second string at a cocked position at least thirty-five centimeters from a resting position of said second string.

4. The shooting bow of claim 2, wherein said locking assembly is configured to receive said second string at a cocked position at least forty centimeters from a resting position of said second string.

5. The shooting bow of claim 2, wherein said locking assembly is configured to receive said second string at a cocked position at least forty-five centimeters from a resting position of said second string.

6. The shooting bow of claim 1, wherein said locking assembly is configured to receive said second string at a cocked position at least thirty-five centimeters from a resting position of said second string.

7. The shooting bow of claim 1, wherein said locking assembly is configured to receive said second string at a cocked position at least forty centimeters from a resting position of said second string.

8. The shooting bow of claim 1, wherein said locking assembly is configured to receive said second string at a cocked position at least forty-five centimeters from a resting position of said second string.

9. The shooting bow of claim 8, wherein said second string guide is a pulley.

10. The shooting bow of claim 1, wherein said first string guide is a cam.

11. A shooting bow comprising:

(a) a frame; .

(b) a first limb;

(c) a second limb;

(d) a first string guide journaled to said first limb at a first point in a manner in which at least a portion of said first string guide extends at least partially forward of, and through, said first limb;

(e) a second string guide journaled to said second limb in a manner in which at least a portion of said second string guide extends forward of, and through, said second limb;

(f) a string coupled from a forward portion of said first string guide to a forward portion of said second string guide;

(g) wherein said first journaling means is located no more than ninety-five centimeters from said second journaling means;

(h) a locking assembly configured to receive said string; and (i) a trigger coupled to said locking assembly.

12. The shooting bow of claim 11, wherein said first point is located no more than eighty-five centimeters from said second point.

13. The shooting bow of claim 12, wherein said locking assembly is configured to receive said second string at a cocked position at least thirty-five centimeters from a resting position of said second string.

14. The shooting bow of claim 12, wherein said locking assembly is configured to receive said second string at a cocked position at least forty centimeters from a resting position of said second string.

15. The shooting bow of claim 12, wherein said locking assembly is configured to receive said second string at a cocked position at least forty-five centimeters from a resting position of said second string.

16. The shooting bow of claim 11, wherein said locking assembly is configured to receive said second string at a cocked position at least thirty-five centimeters from a resting position of said second string.

17. The shooting bow of claim 11, wherein said locking assembly is configured to receive said second string at a cocked position at least forty centimeters from a resting position of said string.

18. The shooting bow of claim 11, wherein said locking assembly is configured to receive said second string at a cocked position at least forty-five centimeters from a resting position of said string.

19. A shooting bow system comprising:

(a) a frame having a front and a back;

(b) a first limb;

(c) a second limb;

(d) wherein said first limb and said second limb are coupled to said frame in a manner in which said first limb and said second limb diverge from one another in a forward direction;

(e) a projectile having a front and a back;

(f) a first string guide journaled to said first limb;

(g) a second string guide journaled to said second limb;

(h) a projectile mounted on said frame;

(i) a string extending from said first string guide to a point behind at least one-half the length of said projectile, and engaged with said second string guide; and (j) wherein said first string guide is journaled to said first limb at a first point no more than ninety-five centimeters from a second point at which said second string guide is journaled to said second limb.

20. The shooting bow of claim 19, wherein said first point is located no more than eighty-five centimeters from said second point.

* * * * *